United States Patent [19]

Berglund

[11] 4,265,444

[45] May 5, 1981

[54] PAPER SHEET STACKER

[75] Inventor: David E. Berglund, Denmark Township, Washington County, Minn.

[73] Assignee: Minnesota Mining and Manufacturing Company, St. Paul, Minn.

[21] Appl. No.: 72,476

[22] Filed: Sep. 4, 1979

[51] Int. Cl.[3] ..... B65H 31/08

[52] U.S. Cl. ..... 271/207

[58] Field of Search ..... 271/207, 209, 213, 225, 271/186, DIG. 9, 189, 278

[56] References Cited

U.S. PATENT DOCUMENTS

| | | | |
|---|---|---|---|
| 2,643,757 | 6/1953 | Kovatch . | |
| 2,767,534 | 10/1956 | Nydegger . | |
| 3,015,487 | 1/1962 | Fiehl | 271/213 |
| 3,948,505 | 4/1976 | Miller | 271/64 |
| 4,002,560 | 1/1977 | Grantham . | |
| 4,026,421 | 5/1977 | Lotz . | |
| 4,083,552 | 4/1978 | Sioman . | |

*Primary Examiner*—Richard A. Schacher

*Attorney, Agent, or Firm*—Cruzan Alexander; Donald M. Sell; John C. Barnes

[57] ABSTRACT

A sheet stacker for use in a paper feeder wherein a pair of arcuate bails are mounted within a frame in a spaced relationship, and are pivotable between a first position where the bails support a falling sheet of paper and direct it toward an output tray, and a second position where the bails are separated so as to release the sheet into the output tray.

5 Claims, 3 Drawing Figures

PAPER SHEET STACKER

This invention relates to a sheet stacking device for use with a paper sheet feeder.

There are many devices for stacking articles as they are furnished from the associated processing equipment. A device for stacking sheets of paper, however, confronts many problems not present in most of the other uses for stacking devices. This is especially true when the paper sheet stacker is incorporated into an office machine, facing utilization in the varied and often inaccurately controlled office environment (e.g., humidity, temperature, etc.). These office machines, such as copy machines or facsimile transmission apparatus require a reliable stacking device which can handle multiple lengths of paper and which approach being impervious to changes in humidity or static electricity while dealing with delicate and lightweight sheets of paper.

The present invention comprises a simple and low cost paper sheet stacking device which is designed to support and stack sheets of varying lengths of paper substantially throughout the range of the curl and beam strength properties resulting from the varying humidity and static electrical conditions of the office environment.

This device comprises a pair of bails having their proximate ends pivotally mounted in a predetermined spaced relationship for movement about an axis generally parallel to the direction that a sheet of paper travels as it is dispensed from a paper sheet feeder. The bails extend downward and generally in a direction opposite that of the feed of the sheet so as to support and direct the sheet as it falls. The sheet stacker is designed to pivot the bails from this supporting position to a position where the paper can fall therebetween to an output tray so as to collect into a stack. The invention also comprises a paper guide plate used to orient the leading edge of the dispensed paper perpendicular to its direction of fall, and a pair of cams adjustably mounted and disposed to determine the extent of the pivotal movement of the bails.

DESCRIPTION OF THE ACCOMPANYING DRAWING

The present invention will be further described hereinafter with reference to the accompanying drawing wherein.

DETAILED DESCRIPTION OF THE PREFERRED EMBODIMENT

Figure 1:
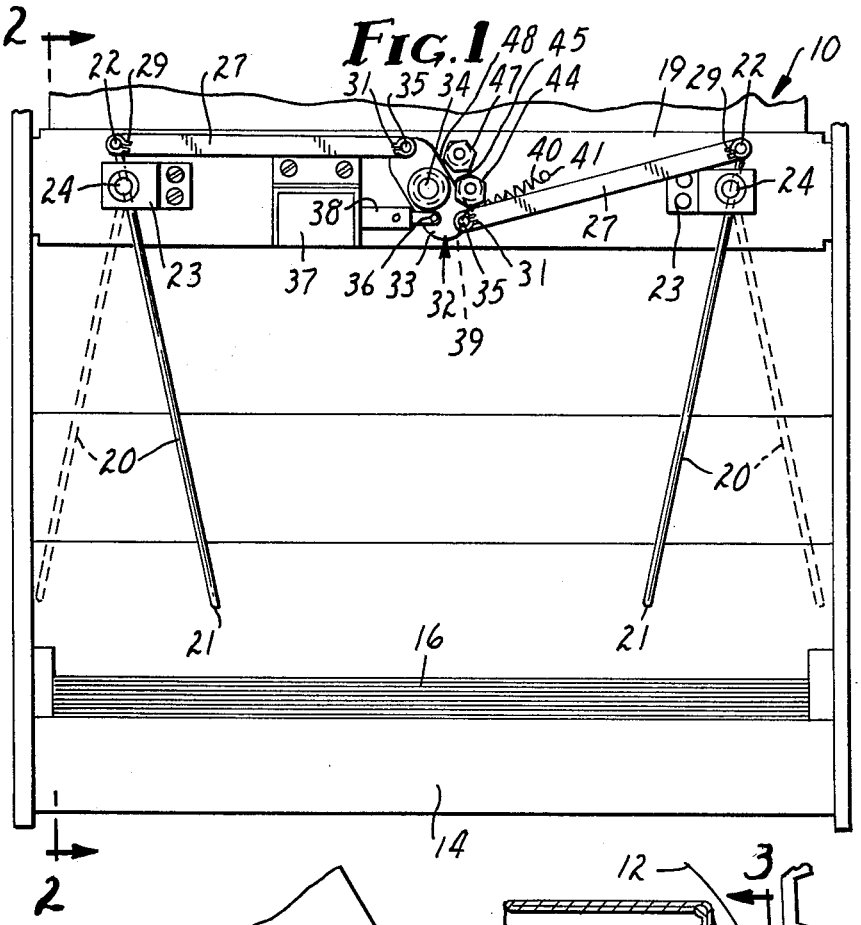
FIG. 1 is a front view of the device according to the present invention.
Figure 3:
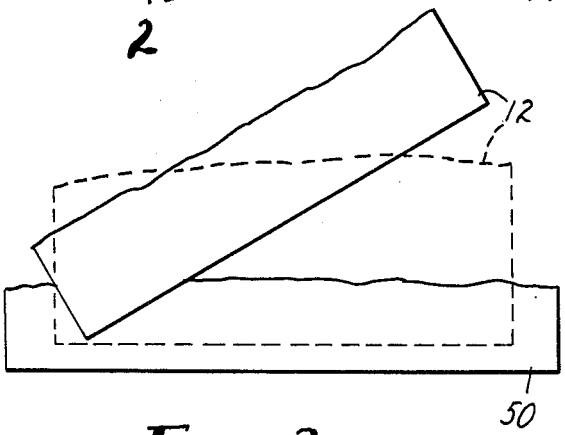
FIG. 3 is a partial front view of the device along line 3-3' of FIG. 2.
Figure 2:
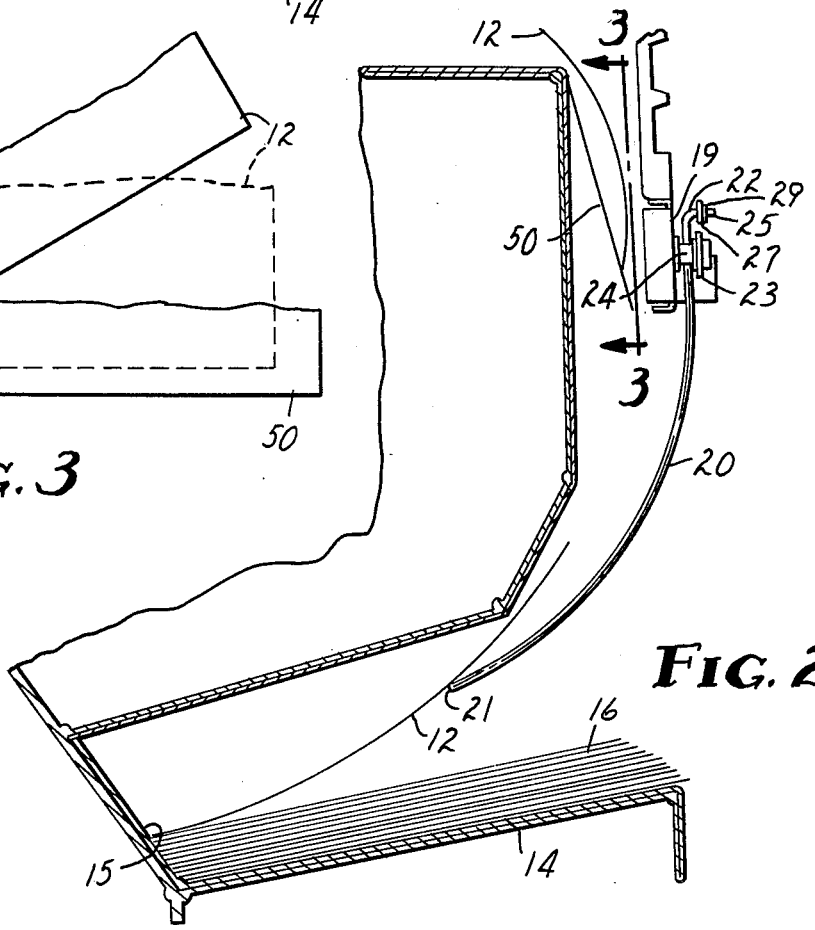
FIG. 2 is a horizontal sectional view taken along line 2-2' of FIG. 1.

The sheet stacker 10, according to the present invention is designed to be used in combination with a paper feeder (not shown) to support a dispensed sheet of paper 12 as it falls thereby controlling its positioning till it reaches an output tray 14. The sheet stacker 10 comprises a pair of arcuate bails 20 having their proximate ends 22 pivotally mounted in a spaced relationship on a frame 19. Each of the bails 20 has a distal end 21 which is positioned above the output tray 14 slightly less than one-half of the way toward the back portion 15 of the output tray 14. This positioning causes the leading edge of the falling paper 12 to contact the back portion 15 of the output tray 14 during its fall. This back portion 15 is angled away from the bail a and as each succeeding sheet of paper 12 falls it orients itself adjacent to this end portion 15 of the output tray 14, thus stabilizing the stack 16 toward the rear of the tray 14. The height (approximately 1½ inch) of the bails 21 above the tray 14 also allows numerous sheets of paper to be stacked before the stacked paper 16 interferes with the bails 20.

The proximate ends 22 of the bails 20 are supported in a clevis assembly mounted to frame 19. The clevis assembly consists of a bracket member 23 affixed to frame 19, with an axle 24 being supported by appropriate bronze bushings between this bracket member 23 and frame 19. Each of the proximate ends 22 of bail 20 passes through a hole within its respective axle 24. In this manner, the rotation of the axle 24 causes a pivotal movement of the bail 20 about the center line of axle 24. As the axle 24 is disposed generally parallel to the direction in which the sheet 12 is being fed, the rotational axis of the bail is likewise generally parallel to the direction of feed.

The bail 20 has a perpendicular projection 25 disposed generally parallel to the axle 24. One end of a linking arm 27 containing a first hole (not shown) is inserted over this perpendicular projection 25 and retained by a retaining ring 29. The perpendicular projection 25 contains a suitable groove (not shown) to support this retaining ring 29. The other end of the linking arm 27 is similarly fastened to a bell crank mechanism 32. This bell crank mechanism comprises a lever portion 33 which is pivotally attached to frame 19 around a centrally positioned fulcrum 34. Suitable retaining rings and bushings are provided for this pivotal motion. At the ends of the lever portion 33 are linking arm pins 35 for attaching the linking arms 27. For this purpose, the linking arms 27 contain a second hole (not shown) which engages the linking arm pins 35. The linking arms 27 are held in position by retaining rings 31. The lever portion 33 also contains a solenoid pin 36 and a tab portion 39. The solenoid pin is used to attach a central shaft 38 of a solenoid 37.

The solenoid 37 is affixed to the frame and electrically connected to the control circuit for the paper feeder. Actuation of the solenoid 37 will cause the bell crank mechanism 32 to pivot. When the solenoid 37 is de-energized, a spring 40 connected between the tab portion 39 of the bell crank mechanism 32 and a pin 41 on frame 19 restores the bell crank mechanism 32 to its original position. The pivotal movement of bell crank mechanism 32 and thus the extent of the pivotal movement of the bails 20 is determined by the action of cams 44 and 47. When the solenoid 37 is actuated, surface 48 of the bell crank mechanism 32 contacts the first cam 47, and limits further pivotal movement of the bell crank mechanism 32 in this direction. When the solenoid 37 is de-energized, surface 45 of the bell crank mechanism 32 contacts cam 44 due to the action of biasing spring 40 and also limits the pivotal motion of bell crank mechanism 32. These cam surfaces 44 and 48 are adjustably mounted to frame 19, and can be varied to change the amount of travel of the bails 20.

The arcuate portion of bails 20 between their distal end 21 and their proximate end 22 is suitably curved to position the distal end 21 of the bail as previously described and to minimize the possibility that a sheet of paper 12 would become caught as it rubs against the surface of the bail 20 while falling.

A guide plate 50 is also affixed to the paper feeding mechanism (not shown) to guide the falling sheet of paper 12 into the sheet stacker assembly 10.

In operation, a sheet of paper is fed from the paper feeder (not shown). A typical embodiment of the paper feeder would employ a roll of paper which is then cut by an appropriate knife means (not shown) into individual sheets 12. The actuation of the knife means also triggers an electrical circuit incorporating a predetermined time delay to allow the sheets 12 to slide past the guide plate 50 and onto the bail 20. If a falling sheet of paper has become disoriented, such that its leading edge is at an angle with respect to its direction of fall, the sliding resistance of the paper against guide plate 50 will tend to straighten out, or, in other words, orient the leading edge of the paper perpendicular to its direction of fall. This is accomplished because the sliding resistance of the paper 12 against the guide plate 50 will slow down the leading point of the falling paper 12 till this sliding resistance becomes equivalent along all other points of the leading edge of the falling paper 12. Thus, as the falling paper 12 approaches the bails 20, its leading edge is generally perpendicular to its direction of fall. The leading edge will slide along the bails 20 and be guided into the output tray 14 being supported by bails 20. It should be pointed out that since the bails 20 direct the falling sheet 12 in a direction opposite that of the feed, the sheet 12 is inverted during the stacking process resulting in the side of the sheet 12 which was uppermost prior to stacking to be faced downward after being stacked. This can be a very desirable feature when the sheet stacker 10 is used with a copy machine or the like wherein the sheet 12 has an exposed side. As the sheet of paper 12 contacts the back portion 15 of the output tray 14, the previously described time delay lapses and the electrical circuit energizes the solenoid 37. Energizing the solenoid 37 will cause a pivotal movement of the bell crank mechanism 32 and result in the bails 20 spreading. This spreading motion releases any supporting effect that the bails 20 have on the paper 12. Being thus released, the paper will fall into output tray 14. The solenoid 37 will remain energized and the bails 20 spread until an electrical signal is received from the device incorporating this invention, instructing the paper stacker to close the bails 20. In this embodiment the electrical signal and the time delay are taken from the circuitry processing the paper and are generally an indication of the length of the document.

The positioning of the bails 20 is an important aspect of this invention. The stacking device must operate in a variety of environmental conditions and the resulting variances in beam strength and curl properties of the paper. Throughout these conditions the bails must be positioned to support the paper and yet upon the energizing of solenoid 37, be able to adequately separate to allow the falling sheet of paper 12 to fall into the paper stack 16.

Having thus described the preferred embodiment of the present invention, it will be understood that changes may be made in size, shape or configuration of some of the parts without departing from the essence of the invention as described in the appended claims.

What is claimed:

1. A paper sheet stacker for use in a paper feeder comprising:

a frame, a pair of bails having their proximate ends pivotally mounted in a predetermined spaced relationship on said frame for movement about an axis generally parallel to the direction of feed of a sheet of paper, each bail having an arcuate portion extending downward and generally in the direction opposite that of the feed of the sheet for supporting and directing the dispensed sheet of paper as it falls from the paper feeder, and each bail terminating in a distal end, means for pivoting said bails about said axis between a first position where said distal ends are closely spaced so as to afford support of a falling sheet of paper by said bails and a second position where said distal ends are separated so as to release the sheet of paper when the sheet has reached a predetermined position, and an output tray disposed beneath said distal end so as to catch the falling sheet of paper upon the release of the sheet by said bails, said tray including an end portion which one edge of the falling sheet contacts.

2. A sheet stacker as claimed in claim 1 wherein said proximate end of said bails is supported in a clevis assembly mounted to said frame, said clevis assembly comprising a bracket member affixed to said frame, an axle rotatably supported between said bracket member and said frame, said axle having a hole through which said proximate end of said bail passes.

3. A paper sheet stacker for use in a paper feeder comprising:

a frame, a pair of bails having their proximate ends pivotally mounted in a predetermined spaced relationship on said frame for movement about an axis generally parallel to the direction of feed of a sheet of paper, each bail having an arcuate portion extending downward and generally in the direction opposite that of the feed of the sheet for supporting and directing the dispensed sheet of paper as it falls from the paper feeder, and each bail terminating in a distal end, means for pivoting said bails about said axis between a first position where said distal ends are closely spaced so as to afford support of a falling sheet of paper by said bails and a second position where said distal ends are separated so as to release the sheet of paper, wherein said means for pivoting said bails comprises a perpendicular projection on said proximate end of said bails, a bell crank mechanism comprising a lever portion rotatably mounted to said frame about a centrally disposed fulcrum, the ends of said lever portion having perpendicular projections for linking said bails, linking arms connecting said perpendicular projection on said bails to said perpendicular projections on the ends of said lever portion, a solenoid connected to said lever portion and affixed to said frame for rotating said lever portion, and biasing means for restoring said lever portion of said bell crank mechanism to an original position, and an output tray disposed beneath said distal end so as to catch the falling sheet of paper upon the release of the sheet by said bails, said tray including an end portion which one edge of the falling sheet can contact.

4. A sheet stacker as claimed in claim 3, further comprising a pair of cams adjustably mounted to said frame and disposed so as to determine the rotational movement of said bell crank mechanism.

5. A sheet stacker as claimed in claim 1, further comprising a guide plate affixed to said frame for guiding the sheet of paper dispensed from the paper feeder so as to orient the leading edge of the sheet perpendicularly with respect to the sheet's direction of fall.

* * * * *